US005316542A

United States Patent [19]

Koch et al.

[11] Patent Number: 5,316,542

[45] Date of Patent: May 31, 1994

[54] COUPLED CONTROL OF OPERATING PARAMETERS OF AN INCUBATOR

[75] Inventors: Jochim Koch, Ratzeburg, Fed. Rep. of Germany; Stefan Frembgen, Pittsburgh, Pa.

[73] Assignee: Drägerwerk Aktiengesellschaft, Lübeck, Fed. Rep. of Germany

[21] Appl. No.: 16,537

[22] Filed: Feb. 11, 1993

[30] Foreign Application Priority Data

Feb. 14, 1992 [DE] Fed. Rep. of Germany ..... 4204398

[51] Int. Cl.[5] ..... A61G 11/00

[52] U.S. Cl. ..... 600/22

[58] Field of Search ..... 600/21-22

[56] References Cited

U.S. PATENT DOCUMENTS 4,034,740 7/1977 Atherton et al. ..... 600/22

FOREIGN PATENT DOCUMENTS 285777 9/1968 Australia ..... 600/22
004103801 8/1992 Fed. Rep. of Germany ..... 600/22
2045978 11/1990 United Kingdom ..... 600/22
2236190 3/1991 United Kingdom ..... 600/22

*Primary Examiner*—Kyle L. Howell
*Assistant Examiner*—J. P. Lacyk
*Attorney, Agent, or Firm*—Walter Ottesen

[57] ABSTRACT

The invention is directed to a method for controlling the operating parameters determining the thermal metabolism of a premature or newborn disposed in an incubator. These operating parameters include the incubator air temperature and the incubator humidity. The method is improved in such a manner that the adjustment of the parameters is coupled to the combination thereof optimizing the thermal metabolism without the necessity of a complex multiple step adjustment for each individual parameter. The method is characterized in that a primary control circuit for controlling the first parameter supplies the actual value corresponding thereto as a control parameter to a logic generator which determines a sequence value by means of a logic function. This sequence value is conducted to a secondary circuit as a desired value for the adjustment of the second parameter.

11 Claims, 1 Drawing Sheet

COUPLED CONTROL OF OPERATING PARAMETERS OF AN INCUBATOR

FIELD OF THE INVENTION

The invention relates to a method for controlling the operating parameters determining the thermal metabolism of a premature or newborn infant disposed in an incubator. These operating parameters include at least the incubator temperature and the humidity to be adjusted in the interior of the incubator. The actual values of these parameters are compared to the desired values corresponding thereto and new desired values are fixed for the parameters when there is a deviation.

BACKGROUND OF THE INVENTION

The control of operating parameters of an incubator always has the purpose to determine the ambient conditions for a premature or newborn in the incubator interior so that the patient loses as little heat from its body to the ambient as possible. Maintaining the thermal metabolism necessary for the well-being of the patient means an increased effort by the patient which is intended to be reduced by the ambient conditions within the incubator. The following parameters are essential for maintaining the desired ambient conditions: incubator air temperature to prevent heat losses by convection, surface temperatures of the incubator hood or the cot to prevent temperature losses via heat conduction or heat radiation as well as the moisture content of the incubator air with this moisture content being most significant. Furthermore, it is important to supply adequate oxygen to the patient in order to support the metabolism generating the heat.

U.S. patent application Ser. No. 07/580,549, filed Sep. 11, 1990, is incorporated herein by reference and suggests coupling those parameters which define the required favorable incubator ambient, via a process computer in such a manner that input values for the parameters are inputted and stored which are orientated to selected variables particular to the patient. The selected variables are directed, for example, to body weight, age, and gestation age. Experience values for the corresponding incubator parameters are known which correspond to these selected variables. The input variables stored in this manner are compared to the actual values from the incubator and cause specific actual value combinations to lead to data as to the heat condition of the patient when there is a drop below pregiven tolerance values or when these tolerance values are exceeded. The desired value of suitable parameters is changed when the maintenance of a required heat condition is no longer ensured. The desired value for the incubator air temperature is increased when, for example, the comparison of the actual values to the stored input values leads to the result that the patient is hypothermic.

In this kind of control of operating parameters of an incubator in dependence upon measured actual values, it is, however, not considered that the change of one parameter also affects the action of another parameter on the thermal metabolism of the premature or newborn. Accordingly, the increase of the incubator air temperature means a reduction of the relative humidity in the incubator air for example, whereby the possibility of evaporation to the ambient from the patient's body is increased and therefore evaporation heat is removed from the patient. On the other hand, a reduction of the incubator air temperature means an increase of the relative humidity so that the body temperature of the patient can even be increased notwithstanding the low incubator air temperature because the capacity for giving up evaporation heat is reduced. Furthermore, it can be necessary that the needed supply of oxygen is reduced when there is a high incubator air temperature and a corresponding warming of the body core temperature.

If for this reason, one of the operating parameters must be reduced with respect to its desired value, then it is necessary to also adapt a second parameter to the changed conditions to obtain an optimal adjustment of the ambient conditions of the premature or newborn in the incubator. This would then mean the additional adjustment of an operating variable by the operator of an incubator which must then be continuously monitored by the operator. The care of the patient located in the incubator must, however, at all times be given priority. For this reason, monitoring of the adjustment of the operating parameters must be reduced to a minimum. This means that the operator is willing to adjust at most one operating parameter.

SUMMARY OF THE INVENTION

It is an object of the invention to improve a method of the kind described above so that during the adjustment of the parameters, which determine the climate in the space surrounding the premature or newborn, the interrelationships which optimize the thermal metabolism are taken into account without the necessity of making complex multiple adjustments for the individual parameters.

According to a feature of the invention, a primary control circuit for controlling a first parameter supplies the corresponding actual value or desired value as a control value to a logic generator, which determines a sequence value by means of a logic circuit. The sequence value is then conducted to a secondary circuit for adjusting the desired value of a second parameter.

With the method of the invention, the primary control circuit for controlling the incubator air temperature to a pregiven desired value and the secondary circuit for adjusting the incubator humidity can be selected. If this selection is made, then the operator has only to adjust the desired incubator temperature whereby the corresponding desired value for the adjustment of the incubator humidity is determined with the aid of the influence of the logic generator. The logic circuit in the logic generator determines the functional relationship between the desired value or the actual value of the first parameter and the desired value of the second parameter. The setting of only a first parameter (for example, the incubator air temperature) acts upon a further parameter in an advantageous manner. This further parameter is significant for the thermal metabolism of the premature or newborn and can, for example, be the humidity. The indirect adjustment of several parameters via the coupling of a logic generator makes possible the adaptation of the parameters to the physiological characteristics of the patient in the incubator.

In addition to the incubator air temperature, the incubator inner wall temperature or the temperature of the cot and the flow velocity of the incubator air can be applied as a first parameter for the primary control circuit.

The actual value as well as the desired value of the first parameter can be utilized as a control value. If the actual value is selected as the control value for the logic generator, then it is possible to obtain a rapid adaptation of the second parameter to the instantaneous state values of the incubator control. This is especially advantageous for the control of such parameters for which the corresponding primary control circuit and secondary circuit have short time constants. On the other hand, it is advantageous to select the desired value of the first parameter as the control value for the logic generator when parameters are controlled for which the corresponding primary control and secondary circuits have a long time constant.

It has been shown that in addition to the incubator air temperature, a change of the humidity has a decisive influence on the thermal metabolism of the patient in the incubator. The incubator temperature is finely adjusted via a targeted finely adjustable metering of moisture to the incubator air and is adjusted so as to be uniformly distributed over the interior of the incubator wherein the patient is accommodated. In this way, only the air temperature remains as a parameter to be adjusted by the operator as is customary. It is therefore advantageous to store memory values in the logic generator which fix the functional relationship between the setting of the incubator temperature as a first parameter and the humidity as a second parameter and that the control value fixes an operating point on the logic function formed in this way by means of which a value pair (control value/sequence value) is determined and the value pair is changed in dependence upon the magnitude of the control value along this logic function. After the preselection or setting of the incubator temperature, the logic function selects the corresponding air humidity and emits this value to the secondary circuit for adjusting the incubator humidity. With each change of the actual value or desired value of the incubator air temperature, the logic function fixes a new applicable desired value for the incubator humidity and supplies this desired value to the secondary circuit.

The primary control circuit, logic generator and secondary circuit can also be operated successfully in the reverse order when, for example, the parameter of the incubator humidity is used as the settable control circuit variable according to which a corresponding incubator air temperature is determined via the logic function.

The settable operating parameters, which are coupled, should consider the physiological characteristics with respect to the thermal metabolism of prematures and newborns. For this reason, it is advantageous to adapt the functional relationship between the operating parameters to be coupled on the basis of selected variables referred to the patient based on experience values. For example, an older newborn or a newborn with higher birth weight requires a lower humidity at a pregiven incubator temperature than a patient having a lower weight and younger in age since the skin surface of the older newborn evaporates less body liquid because of its more mature development and thereby loses less evaporation heat. This patient can stay in a dryer atmosphere. For this purpose, the memory values are stored in a multi-dimensional table. In this tabular form, one dimension is fixed by the relationship of the parameters of temperature and humidity. A third dimension and, if necessary, a further dimension are superposed on this dimensional plane with the third and further dimension being determined by one or more selected variables particular to the patient. By fixing the third and further dimension by means of the input of selected variables, a multi-dimensional logic function is selected which corresponds to this dimension. In this way, the simplest tabular form is that which sets up a two-dimensional association of temperature and humidity for which standard values of selected values particular to the patient such as age, weight at birth, gestational age are fixedly pregiven in the logic generator. In accordance with the conditions present, the user can leave the standard plane defined in this manner by inputting other selected variables particular to the patient and select a logic function adapted to the changed selected variables. The user then is provided with a possibility of selection from a plurality of sets of characteristic curves which fix the particular logic functions which are assigned to the pregiven selected variables. For example, for a small premature infant, the increase of incubator humidity with increasing incubator temperature must take place at a steeper slope than with a premature which has been in the incubator for a longer time and has taken on a correspondingly larger body weight.

According to another embodiment of the invention, it is advantageous to configure the secondary circuit as a second control circuit wherein an actual value transducer for the second parameter is connected to the circuit and the actual value is compared to the desired value supplied by the logic generator. The setting is changed when there is a deviation of the two values from each other. In this way, two coupled control circuits for different operating parameters are obtained which operate as master-slave control circuits. The first control circuit determines the desired value of the second control circuit via a logic generator.

It is appropriate to provide upper and/or lower limit values for the logic function in order to limit the open-loop and/or closed-loop control of the coupled operating parameters to the values advantageous for the thermal metabolism of the premature and newborn. Only the control value of the first parameter can be changed without the sequence value being changed therewith when the operating point exceeds the particular upper or lower limits. As an example, if one selects again the incubator air temperature as the control value and the humidity as the sequence value in a cartesian coordinate system (with the incubator temperature defining the independent variable and the incubator humidity defining the dependent variable), then the logic function runs outside the upper and lower limit values in a horizontal direction. A shift of the operating point as a consequence of a change of the actual value or desired value of the incubator air temperature then means that there is no longer any change of the corresponding incubator humidity.

Under given circumstances, it can be necessary to interrupt the coupling of the operating parameters in order to individually adjust each parameter, for example, when the upper and lower limit values of the logic function are exceeded or there is drop below the lower limit value and if it is intended to effect a change of the desired values for both control circuits or when the treatment makes it necessary to provide individual combinations of adjusting parameters independently of the inputted selected variables specific to the patient. In these cases, conducting the control value to the logic generator is prevented by an interrupt switch. The interrupt switch can be located at a point advantageous for the switching operation in the circuit path between the control circuit for the first parameter and the circuit or control circuit for the second parameter. When the interrupt switch is open (that is, when the circuit path between the control circuit or circuit is interrupted), the desired value for each parameter can be inputted individually via a corresponding input unit to the control circuit or to the circuit.

An incubator for carrying out the method for coupled control of operating parameters has an enclosed space for the premature or newborn wherein a cot is provided and an equipment space wherein a blower is mounted for circulating the air in the enclosed space. The air of the enclosed space is humidified by a humidifier and warmed by a heater. The incubator air temperature is adjusted and maintained by means of a temperature control circuit. The humidifier is connected to a circuit for adjusting the moisture to be supplied to the air of the enclosed space. The control circuit for the incubator air temperature is connected to a logic generator which receives the actual value or desired value as a control value. The logic generator is connected to the circuit for supplying a sequence value to this circuit. The actual value or desired value is important for the control circuit and the sequence value is determined from the control value with the aid of a logic function. The sequence value influences the control of the humidifier as a desired value.

The circuit for adjusting the incubator humidity can be expanded to a control circuit in a simple manner in that a moisture sensor is connected to this circuit and the actual value supplied thereto. The adjustment of the humidifier for obtaining the desired value is influenced by means of a comparison of the desired and actual values and when there is a corresponding deviation.

An interrupt switch is mounted in the circuit path between the primary control circuit, logic generator and secondary circuit in order to make possible a separate and individual input of desired values to the primary control circuit or to the secondary circuit under given circumstances.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
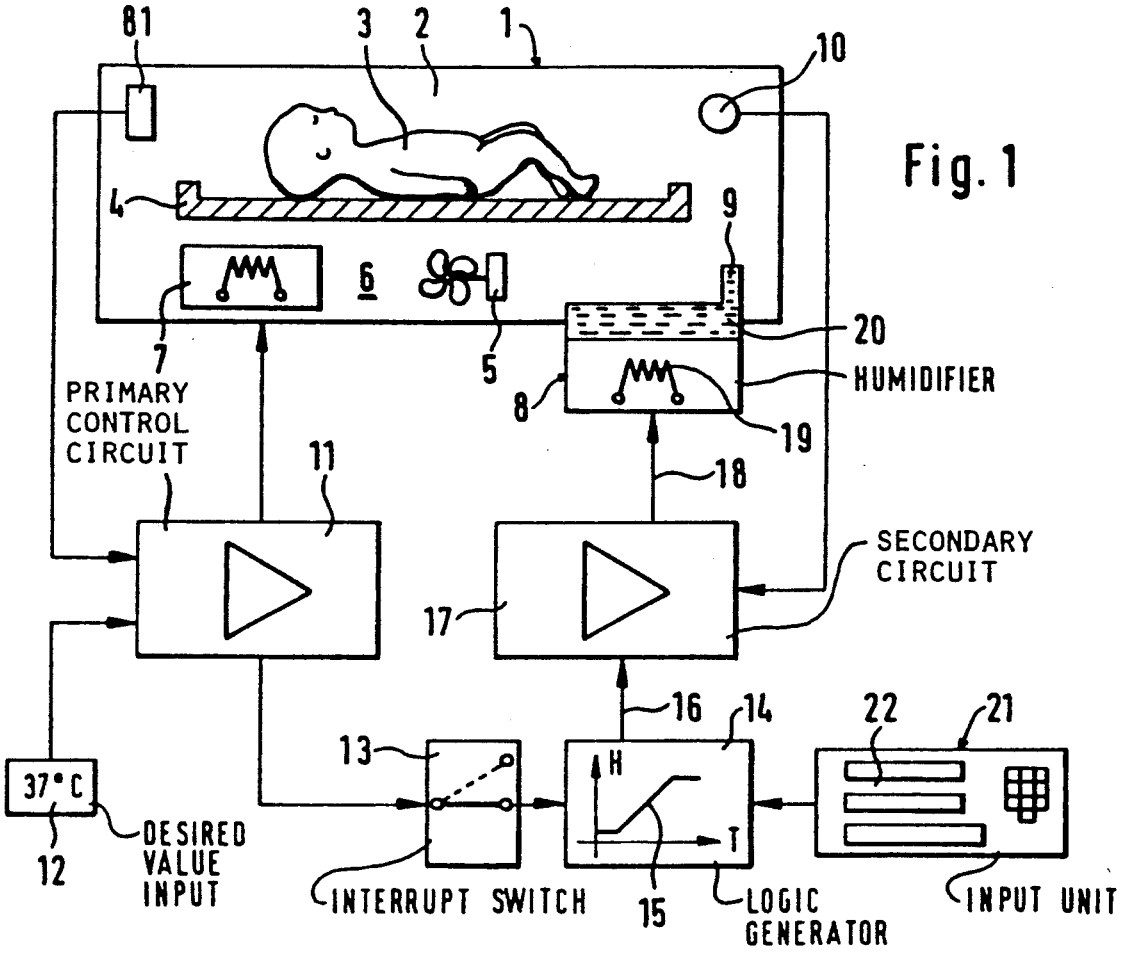
FIG. 1 is a schematic of an incubator and the coupled control of two operating parameters thereof; and, FIG. 2 is a diagram showing the functional relationship between two operating parameters by means of a logic function.

In FIG. 1, an incubator 1 is shown having an interior space 2 which defines the holding space for a premature 3 lying on a cot 4. The air in the interior space of the incubator is circulated by means of a blower 5 in the equipment space 6. The circulated air is conducted over a heater 7 as well as over a humidifier 8. The heater 7 warms the incubator air to a preselected temperature value detected by an air-temperature sensor 81. The incubator air passes over the humidifier opening 9 of the humidifier 8 during circulation of the incubator air. Water vapor becomes entrained in the incubator air at the humidifier opening 9 in varying quantities.

The moisture content of the incubator air is detected by a humidifier sensor 10. The measured value measured by the air-temperature sensor 81 is supplied to a primary control circuit 11 as an actual value. The primary control circuit 11 compares the actual value to a desired value which is inputted via a desired-value input 12 to the primary control circuit. The primary control circuit 11 is a power control circuit which influences the heater power of the heater 7 in such a manner that the required desired value is detected at the air-temperature sensor 81.

Figure 2:
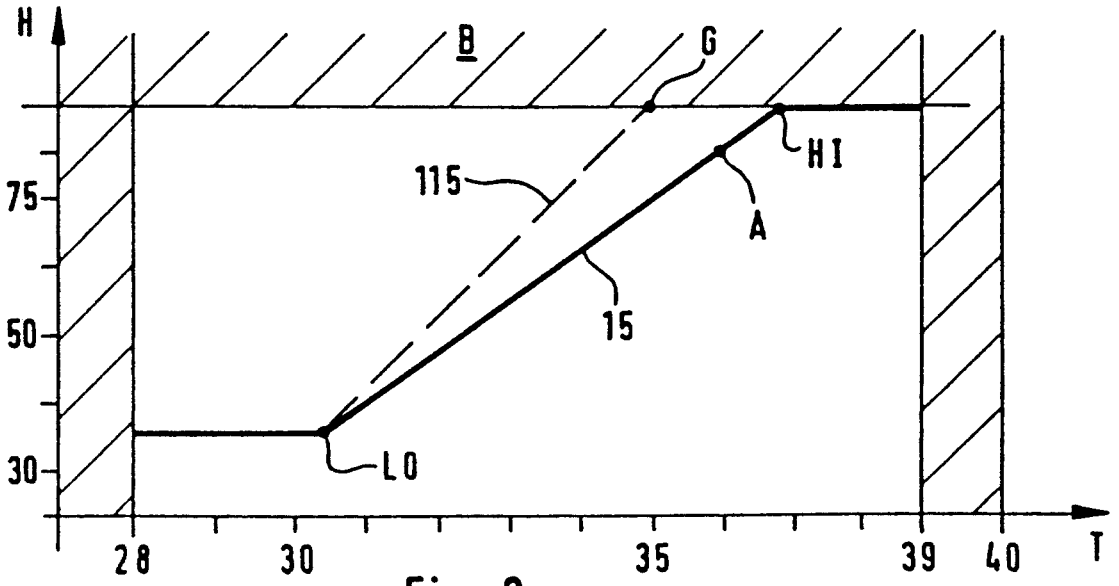

Either the desired value or the actual value is transmitted by the primary control circuit 11 as a control value to a logic generator 14 via a closed interrupt switch 13. The control value is, in this example, the actual value of the incubator air temperature and is measured by the air-temperature sensor 81. This control value is brought into functional relationship with the relative humidity measured by the humidity sensor 10. This functional relationship is defined by a logic function 15 (FIG. 2).

An operating point A is fixed on the logic function 15 in dependence upon the measured air temperature T. A value for the humidity H corresponds to this operating point A. This humidity value is supplied via a signal line 16 to a secondary circuit 17 as a sequence value which defines the desired-value input for this circuit 17 with the desired-value input being for the humidity in the incubator 1. This desired value is compared to the actual value of the humidity as determined by the humidity sensor 10. A moisture heater 19 of the humidifier 8 is controlled via a heater control line 18 in response to a corresponding deviation between the actual value and the desired value (sequence value). A water reservoir 20 disposed above the humidifier heater 19 is heated in dependence upon the heating capacity of the humidifier heater whereby a pregiven quantity of vaporized liquid is supplied to the interior space air circulated by the blower 5. The logic generator 14 is connected to an input unit 21 having a keypad 22 by means of which selected data particular to the patient is inputted whereby different logic functions 15 are fixed in the logic generator 14.

The selected data particular to the patient and inputted via the input unit 21 relates to the patient 3 located in the holding space 2 so that, in the logic generator 14, a logic function 15 is produced referred especially to this patient and establishes the connection between the set incubator air temperature and the required incubator humidity. The interrupt switch 13 is moved into its open switching position shown in phantom when the desired values of the primary control circuit 11 and the secondary circuit 17 are to be inputted independently of each other. The required input of the desired values for the incubator air temperature is inputted via the desired-value input 12 and the desired value of the incubator humidity is inputted via the input unit 21.

In a simplification of the control circuit (10, 17, 8), the humidity sensor 10 can be removed and the secondary circuit 17 sets the humidifier heater 19 to pregiven heating levels in dependence upon a preselected temperature. The heating levels can be subdivided into ten equal parts from a minimum to a maximum which corresponds to a relative humidity of, for example, 35 to 85%. Only the association between the air temperature and the heating levels must be brought into relationship to each other in the logic generator 14.

A functional relationship between the incubator air temperature T and the incubator humidity H is shown in FIG. 2. Parameter values lie in the hatched region B which should not be selected for the control of the climatic conditions in the holding space 2 of the incubator 1. The parameter range of the temperature T extends from 28° C. to 39° C. and the parameter range of the humidity H extends from 25% relative humidity to 85% relative humidity.

The logic function 15 is fixed for a patient 3 located in the incubator 1 and corresponds to the selected data inputted via input unit 21 and specific to the patient. Accordingly, for a selected incubator air temperature of 36° C., the operating point A moves to a position corresponding to relative humidity of 78%. This humidity value is emitted by the logic generator 14 as a sequence value via the line 16 to the secondary circuit 17 and is there processed as a desired value for adjusting of the humidifier 8.

An upper limit value HI for the incubator air temperature lies at 37° C. and when this value is exceeded, a constant relative humidity of 85% remains set. The adjusted relative humidity remains constant at 35% when there is a corresponding drop below a lower limit value LO at 30.5° C. If other selected data particular to the patient are inputted into the input unit 21, for example, for a very small premature, a logic function 115 is selected which is fixed along the trace represented by the broken line. The relative humidity to be adjusted increases with increasing incubator air temperature at a greater slope and reaches the upper limit value G already at approximately 34.7° C.

It is understood that the foregoing description is that of the preferred embodiments of the invention and that various changes and modifications may be made thereto without departing from the spirit and scope of the invention as defined in the appended claims.

What is claimed is:

1. An incubator for controlling an environment for an infant, the incubator comprising:

a housing having a base and an enclosure mounted on said base for defining an enclosed space adapted to the infant and wherein the environment for the infant is controlled;

said housing defining an equipment compartment;

circulating means mounted in said equipment compartment for circulating incubator air through said enclosed space;

first parameter means for imparting a first physical change to the environment within said enclosed space measurable as a first operating parameter of said environment;

second parameter means for imparting a second physical change to the environment within said enclosed space measurable as a second operating parameter of said environment;

sensing means for sensing said first operating parameter and for supplying a first signal indicative of the actual value of said first operating parameter;

desired value generator means for supplying a second signal indicative of a desired value of said first operating parameter;

primary control circuit means for comparing said first and second signals and for driving said first parameter means to set and maintain said first operating parameter in dependence upon the comparison of said first and second signals;

logic generator means for defining a functional relationship between said first and second operating parameters;

said logic generator means being connected to said primary control circuit for receiving one of said first and second signals as a control value and for generating an output sequence signal based on said functional relationship and said control value with said output sequence signal defining a desired value of said second operating parameter; and, secondary circuit means connected to said logic generator means for generating a drive signal for driving said second parameter means based on said output sequence signal.

2. The incubator of claim 1, further comprising:

said sensing means being a first sensing means and said incubator;

second sensing means for sensing said second operating parameter and for supplying a third signal indicative of said second parameter; and, said secondary circuit means being adapted to compare said third signal to said output sequence signal to generate said drive signal based on a comparison of said third and said output sequence signals until said third signal has changed to correspond to said desired value of said second operating parameter.

3. The incubator of claim 2, further comprising:

a cot mounted on said base and adapted to hold the infant;

said circulating means being a blower mounted in said equipment compartment;

said first parameter means being a heater for heating the air circulated by said blower;

said second parameter means being a humidifier for imparting moisture to the circulated air;

said first sensing means being a temperature sensor for sensing the temperature of the circulated air as said first operating parameter; and, said second sensing means being a humidity sensor for sensing the humidity as said second operating parameter.

4. The incubator of claim 1, further comprising: a circuit path connecting said primary control circuit means to said logic generator means; and, an interrupt switch connected into said circuit path for interrupting said circuit path thereby preventing said control value from reaching said logic generator means.

5. The incubator of claim 1, further comprising:

a cot mounted on said base and adapted to hold the infant;

said circulating means being a blower mounted in said equipment compartment;

said first parameter means being a heater for heating the air circulated by said blower;

said second parameter means being a humidifier for imparting moisture to the circulated air; and, said sensing means being a temperature sensor for sensing the temperature of the circulated air as said first operating parameter.

6. A method for controlling an environment for an infant in an incubator having a housing which includes a base and an enclosure mounted on the base for defining an enclosed space for accommodating the infant therein and wherein the environment for the infant is controlled, the method comprising:

circulating the incubator air through said enclosed space;

imparting a first physical change to the environment within said enclosed space utilizing a first parameter means with said first physical change being measurable as a first operating parameter;

imparting a second physical change to the environment within said enclosed space utilizing a second parameter means with said second parameter means being measurable as a second operating parameter;

sensing said first operating parameter utilizing sensing means and providing a first signal indicative of the actual value of said first operating parameter;

supplying a second signal indicative of a desired value of said first operating parameter utilizing desired value generator means;

comparing said first and second signals and utilizing a primary control circuit means for driving said first parameter means to set and maintain said first operating parameter in dependence upon the comparison of said first and second signals;

defining a functional relationship between said first and second operating parameters utilizing a logic generator;

applying one of said first and second signals as a control value to said logic generator and utilizing said logic generator to generate an output sequence signal based on said functional relationship and said control value with said output sequence signal defining a desired value of said second operating parameter; and, generating a drive signal in a secondary circuit connected to said logic generator and driving said second parameter means based on said output sequence signal.

7. The method of claim 6, wherein: said first parameter is the temperature in said incubator and said second parameter is the humidity in said incubator; and, the method includes the further steps of:

storing values in said logic generator which determine the functional relationship between said incubator temperature and said humidity;

determining an operating point (A) on said functional relationship with said control value thereby determining a value pair (control value/sequence value); and, changing said operating point (A) along said functional relationship in dependence upon the magnitude of said control value.

8. The method of claim 7, wherein: said values stored in said logic generator are stored in a multi-dimensional table having a dimension plane which is determined by the association of the said parameters of temperature and humidity defining first and second dimensions, respectively.

9. The method of claim 8, wherein: a third dimension is superposed on said dimension plane with said dimension being determined by a selected variable specific to the infant; and, a multi-dimensional logic function corresponding to this dimension is selected by determining said third dimension by inputting the selected variable.

10. The method of claim 7, wherein: said logic function has an upper limit value (HI) and a lower limit value (LO); and, a displacement of said operating point (A) takes place only parallel to said control value when said upper limit value (HI) is exceeded and when there is a drop below said lower limit value (LO).

11. The method of claim 6, comprising the further step of utilizing an interrupt switch to interrupt a circuit path between said primary control circuit and said logic generator.

* * * * *

UNITED STATES PATENT AND TRADEMARK OFFICE

CERTIFICATE OF CORRECTION

PATENT NO. : 5,316,542

DATED : May 31, 1994

INVENTOR(S) : Jochim Koch and Stefan Frembgen

It is certified that error appears in the above-identified patent and that said Letters Patent is hereby corrected as shown below:

In column 6, lines 16 and 17: delete "measured by the humidity sensor 10. This functional relationship is" and substitute -- as -- therefor.

Signed and Sealed this

Twentieth Day of September, 1994

Bruce Lehman

*Attest:*

BRUCE LEHMAN

*Attesting Officer*

*Commissioner of Patents and Trademarks*